United States Patent [19]

Fox

[11] 4,103,885

[45] Aug. 1, 1978

[54] TIMING MECHANISM FOR SHEET FEED APPARATUS

[75] Inventor: Richard Samuel Fox, Rochester, N.Y.

[73] Assignee: Eastman Kodak Company, Rochester, N.Y.

[21] Appl. No.: 830,255

[22] Filed: Sep. 2, 1977

[51] Int. Cl.[2] ..... B65H 3/06

[52] U.S. Cl. ..... 271/117; 271/265

[58] Field of Search ..... 271/117, 118, 147, 153, 271/154, 265, 110, 111

[56] References Cited

U.S. PATENT DOCUMENTS 2,571,942 10/1951 Properzi ..... 271/117

3,218,062 11/1965 Wickland ..... 271/153 X

*Primary Examiner*—Richard A. Schacher

*Attorney, Agent, or Firm*—Lawrence P. Kessler

[57] ABSTRACT

Sheet feed apparatus comprising means in engagement with the topmost sheet of the supply stack for feeding discrete sheets seriatim from the top of the stack in response to a feed signal. The level of the top sheet in the stack is sensed and a position signal is produced which corresponds to the top sheet level. The timing of the feed signal is varied in accordance with the position signal so that the topmost sheet is fed to arrive at a sheet utilization device during a predetermined portion of the time cycle of the utilization device regardless of the level of the supply stack.

9 Claims, 8 Drawing Figures

TIMING MECHANISM FOR SHEET FEED APPARATUS

BACKGROUND OF THE INVENTION

1. Field of the Invention

This invention relates generally to sheet feeding apparatus, and more particularly to a timing mechanism for a sheet feeder which assures the feeding of a sheet from the top of a supply stack at a particular time, depending upon the height of the stack, whereby said sheets are received at a sheet utilization device during a predetermined portion of the operative cycle of the sheet utilization device.

2. Description of the Prior Art

In the field of printing or high speed copy/duplicating, it is common practice to feed discrete copy receiving sheets to the printing station from a stack of sheets supported in a supply hopper. Feeding of the sheets may be accomplished either pneumatically or mechanically. During their transport between the supply hopper and the printing station, the sheets usually pass through a registration station to insure proper synchronization and alignment of the sheet with the arrival of an image to be copied in the printinng station. As the operating speed of the modern printing apparatus has increased, the available period of time for transport and registration of copy receiving sheets has decreased. Moreover, the importance of feeding single sheets (i.e., prevention of multiple sheet feeds) has increased.

One type of sheet feed apparatus capable of high speed operation for feeding of single discrete sheets from a supply stack is the well known scuff feeder. Scuff feeders, comprising friction rollers or pads, are generally located above the stack of sheets so that the weight of the feeder (or perhaps the force from an additional urging mechanism) provides sufficient frictional force with the topmost sheet to feed discrete sheets one at a time from the stack. If the stack of sheets is supported on a fixed base, the length of the feed path from the stack to the printing station (or the registration station) changes with changes in the height of the stack. While in the instance of slower speed printing apparatus the longer feed path may be inconsequential in the operation cycle, in the the case of high speed apparatus, the length of time a sheet remains in the longer feed path may exceed the operation cycle time required for feed and registration of the sheet prior to printing. One way to insure adequate feed and registration in high speed printing apparatus is to maintain a constant length sheet feed path. To achieve a constant length feed path, the scuff feeder is generally supported in a fixed position relative to the printing station and the supply stack is supported on an adjustable platform which is periodically raised to insure contact of the topmost sheet in the stack with the feeder (as for example, U.S. Pat. Nos. 3,995,952; 4,008,957). However, elevator mechanisms in general use for raising the stack supporting platform to maintain the topmost sheet of the stack at a particular position relative to the scuff feeder to insure accurate single sheet feeding are of relatively complicated construction.

SUMMARY OF THE INVENTION

In accordance with the present invention, sheet feed apparatus is provided for feeding sheets seriatim from the top of a supply stack, the timing of a feed signal for feeding of discrete sheets being adjusted according to the level of the stack from which the sheets are being fed to eliminate the need for a stack elevator. The level of the top sheet in the stack is sensed and a position signal is produced which corresponds to the top sheet level. The timing of the feed signal is varied in accordance with the position signal so that the topmost sheet is fed to arrive at a sheet utilization device during a predetermined portion of the time cycle of the utilization device regardless of the level of the supply stack.

In particular, the sheet feed apparatus includes a scuff roller supported by a pivotable arm in feeding engagement with the top sheet of the sheet supply stack regardless of changes in the height of the stack during sheet feeding. A motor drives the scuff roller, through a selectively actuated clutch for feeding discrete sheets seriatim from the supply stack to a registration mechanism. The registration mechanism aligns and/or synchronizes the movement of the sheets relative to the arrival of an image to be copied at a downstream location, such as a printing station of an electrophotographic copier. The clutch actuation is controlled by a timing mechanism to assure timely arrival of the sheets at the registration mechanism. The timing mechanism includes means for producing a clutch actuation signal and means coupled to the scuff roller support arm for determining the angular position of the arm and producing a signal based on that angular position for adjusting the timing of the clutch actuation signal. Since the angular position of the arm is directly related to the instantaneous height of the sheet supply stack, the clutch actuation signal is directly related to the height of the stack. The timing of operation of the scuff feeder for feeding of discrete sheets is thus adjusted (relative to the copier time cycle) dependent upon the level of the topmost sheet in the supply stack to compensate for changes in the length of the sheet feed path to the registration mechanism.

DESCRIPTION OF THE PREFERRED EMBODIMENT

Figure 1:
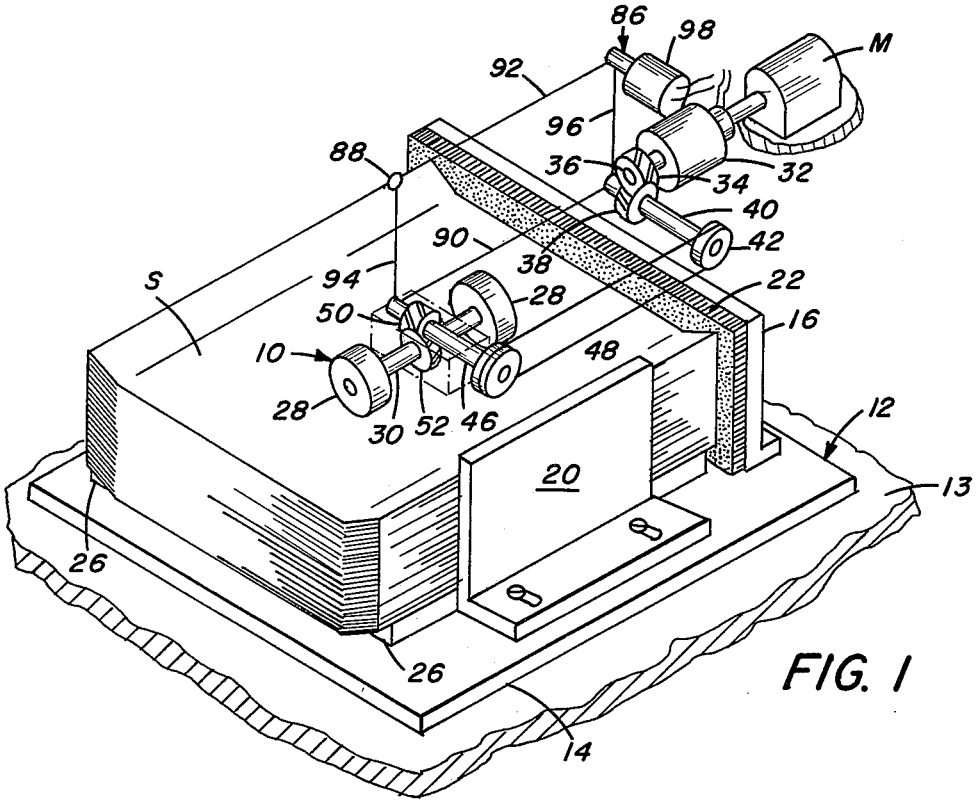
FIG. 1 is a generally schematic perspective view of the sheet feed apparatus according to this invention and a sheet supply cassette, with portions removed to facilitate viewing.
Figure 2:
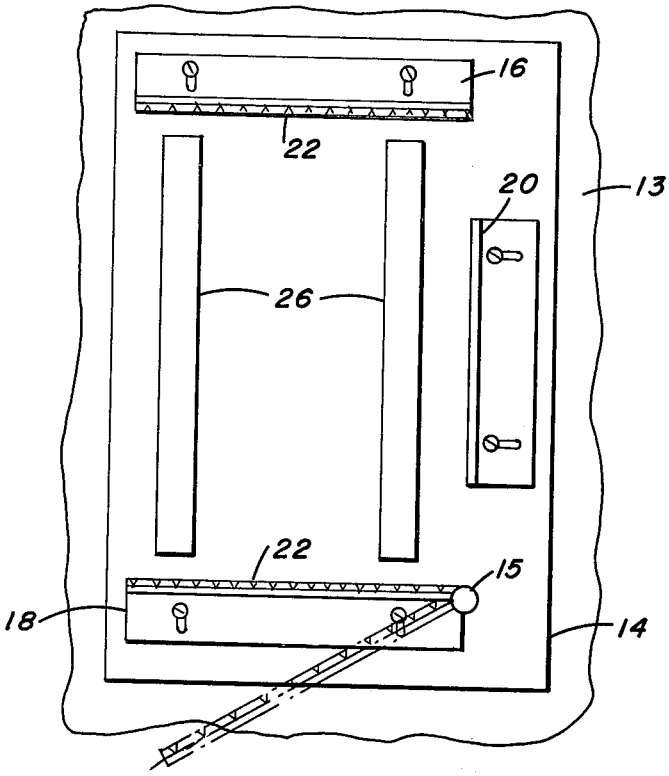
FIG. 2 is a top plan view of the sheet supply cassette of FIG. 1.
Figure 3:
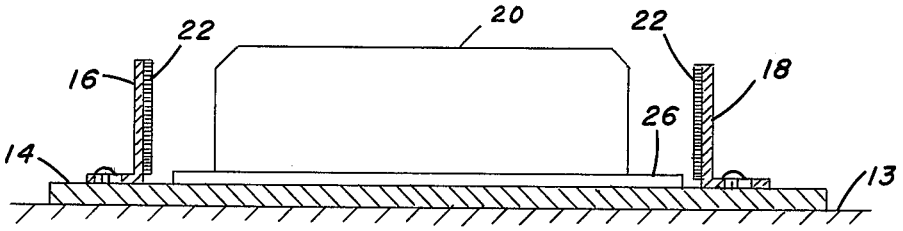
FIG. 3 is a front elevational view, partly in section, of the sheet supply cassette of FIG. 1.

Referring now to the drawings, a sheet feed apparatus 10 is shown in FIG. 1 for use in a sheet utilization device, such as for example, an electrophotographic copier. The sheet feed apparatus 10 feeds discrete sheets seriatim from a sheet supply stack S contained in a sheet supply cassette 12 supported on a deck 13 within the copier to an image bearing member 60 and registration mechanism 62 (see FIG. 5) of the copier. The cassette 12 has a base 14 upon which vertical side plates 16, 18 are mounted (see FIGS. 2 and 3). The side plates are laterally adjustable on the base 14 to accommodate varying sheet sizes. Additionally, side plate 18 is pivotably mounted on the base 14, by hinge 15, for movement out of the way during loading of the cassette with a stack of sheets. A vertical rear plate 20 is also adjustably mounted on the base 14 to support and spatially position the rear edge of the stack S within the cassette 12. Since each of the plates can be individually positioned on base 14 a wide range of sheet sizes may be accommodated within the cassette.

The side plates 16 and 18 are covered with a plush fibrous material 22. When a stack of sheets is placed in the cassette 12, the side plates 16 and 18 are adjusted to provide interference between the discrete sheets of the stack and the fibers of the plush material 22. As an illustrative example, the fibers of the plush material maybe 0.190 inches long and the interference maybe set to be between 0.050 to 0.060 inches. Such interference effectively separates the sheets in the stack, thus reducing the possibility of multi-sheet feeds. Additionally, spaced parallel wedge shaped members 26 are mounted on the base, transverse to the direction of feed, which cause the stack to assume a dished shaped contour (see FIG. 1). This concave configuration of the stack breaks the edges of successive sheets from one another and adds beam strength to each discrete sheet in the stack. The added beam strength keeps the edges of the sheet straight, and assures that the sheets travel across the grain of the plush material 22 as they are fed by the feed apparatus 10. Such arrangement significantly contributes to the prevention of misfeeds or multiple feeds. Moreover, to increase the friction forces on the bottom sheet in the stack in order to reduce multiple feeding when only several sheets remain in the stack, the base 14 is provided with a roughened surface, by placing for example sandpaper or other material having a high coefficient of friction on the base.

Figure 4:
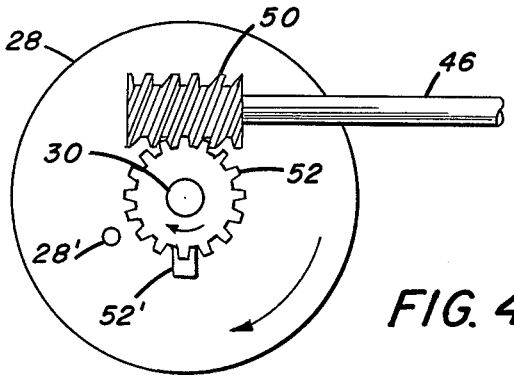
FIG. 4 is a side elevational view of a portion of the drive for the sheet feed apparatus of FIG. 1.

Returning to FIG. 1, the sheet feed apparatus 10 comprises scuff feed rollers 28 having friction surfaces, such as rubber or open cell polyurethane. The rollers 28 are mounted on a rotatable shaft 30. The shaft 30 is driven through a selectively actuated clutch 32 by a motor M which is operated at a substantially constant speed (RPM). The drive train between the clutch 32 and the shaft 30 includes a helical gear 34 fixed on an output shaft 36 from the clutch. The gear 34 drives a helical gear 38 which is rigidly mounted on a shaft 40. The shaft 40 supports a pulley 42 which is drivingly coupled via drive belt 48 to a pulley 44 fixed on a shaft 46. Shaft 46 also carries a helical gear 50 which drives a helical gear 52 fixed on the shaft 30 to impart rotation to the shaft 30. The gear 52 has a tab 52' which engages pin 28' extending from rollers 28 (see FIG. 4). The tab and pin drive for the rollers 28 provides an overide feature which permits their angular velocity to exceed the angular velocity of the gear 52 (e.g., when a sheet being fed is advanced by the registration mechanism 62). The shafts 30, 40 and 46 are supported in spatial relationship in a housing (shown in phantom in FIG. 1) which is vertically free floating to enable the rollers 28 to be in feeding engagement with the topmost sheet in the stack S and follow the height of the stack as sheets are fed therefrom to deplete the stack.

Figure 5:
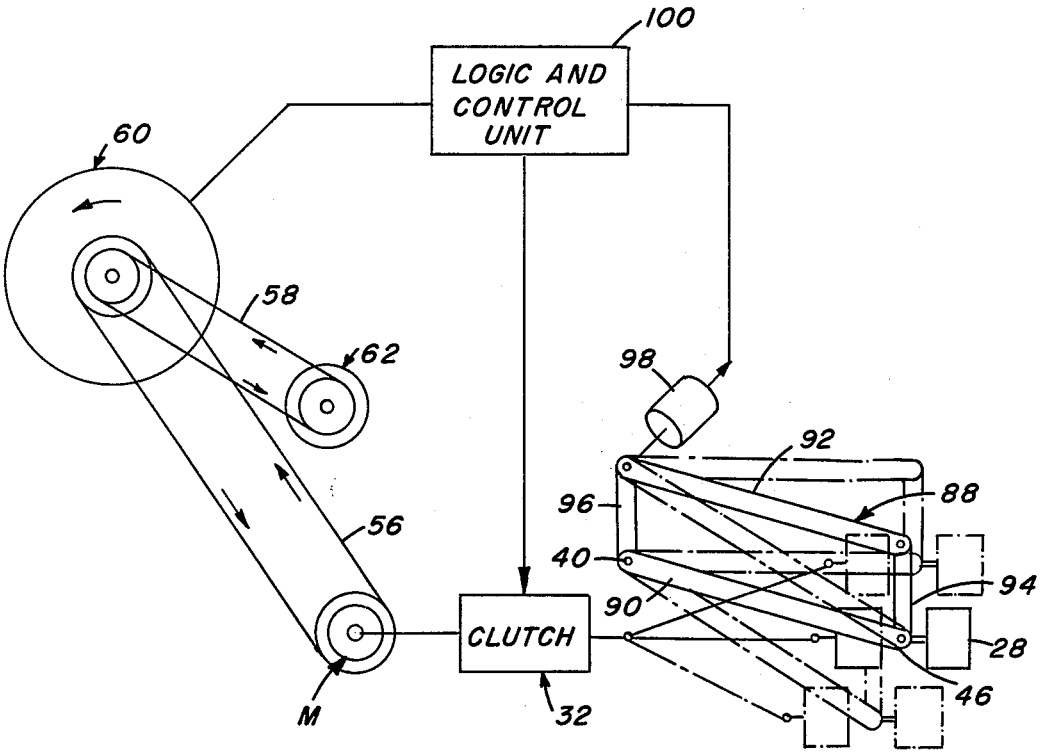
FIG. 5 is a schematic illustration of the sheet feed apparatus of FIG. 1 coupled by a timing and control mechanism to a sheet utilization device.

The motor M may also serve as the main drive for the image bearing member 60 (such as a photoconductive member of the electrophotographic copier) and the registration mechanism 62 through belts 56 and 58 (see FIG. 5). The image bearing member 60 is rotated in an operative cycle through electrophotographic processing stations (not shown) wherein the member is sequentially charged, exposed to a reflected light image of a document to be copied to form a latent charge pattern on the member, and developed by oppositely charged developer material. The registration mechanism 62 receives a sheet fed from the stack S by the feed apparatus 10 and times the transport of the sheet and aligns the sheet to arrive in registered engagement with a developed image on the image bearing member 60 at a transfer station. The speed of the sheet upon engagement with the image bearing member 60 is substantially equal to the tangential velocity of the image bearing member, whereby registered transfer of the image is made to the sheet by any standard electrophotographic process (see, for example, U.S. Pat. No. 3,301,551).

Figure 6:
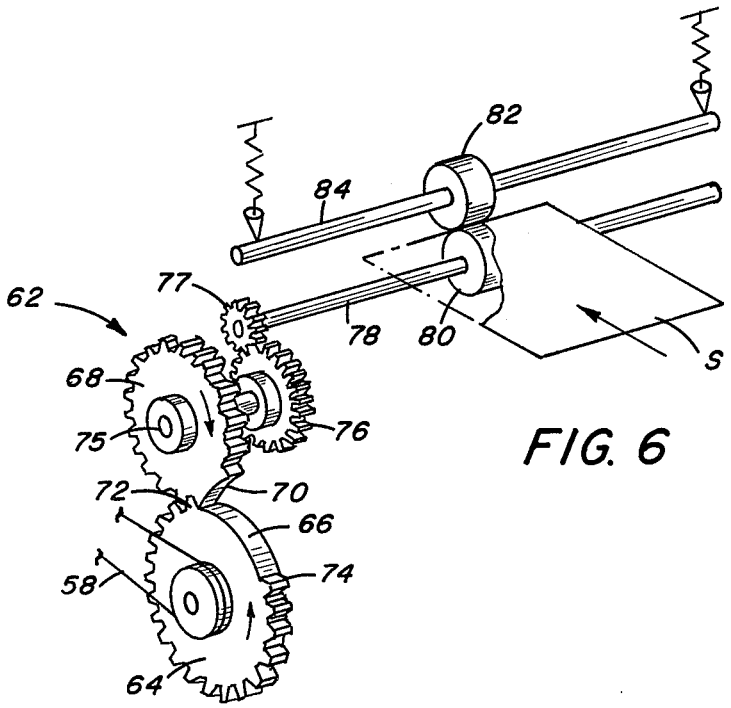
FIG. 6 is a generally schematic view, in perspective, of a registration mechanism used in the sheet utilization device of FIG. 5.

One such registration mechanism capable of functioning in the described manner is shown in FIG. 6. A first spur gear 64 is driven for continuous rotation (in the direction of the arrow) by the motor M, in timed relation to the rotation of the member 60, by the belts 56 and 58. The gear 64 has a segment 66, over a portion of its circumference, with the gear teeth removed. A second spur gear 68 is intermeshed with gear 64 and is driven by the gear 64 for intermittent rotation. The gear 64 has a follower land 70 of concave shape. As the last tooth 72 drives the gear 68, the land 70 engages the segment 66. Due to the engagement of the land 70 with the segment 66, the gear 68 is locked against rotation until the first tooth 74 of the gear 64 engages the land 70 to once again impart rotational drive to the gear 68. The gear 68 is fixed on a shaft 75 which also carries a gear 76. The gear 76 thus intermittently drives gear 77 fixed on a shaft 78. The shaft 78 carries at least one sheet registration and feeding roller 80 positioned in the sheet feed path. A freely rotating roller 82 is carried by a shaft 84 and is located on the shaft to form a nip with roller 80. The shaft 84 is urged in a direction to provide pressure engagement between the rollers 80 and 82 at their nip. The gears 76 and 77 are of a selected diameter to rotate shaft 78 at a speed to establish a velocity for a sheet fed by the rollers 80 and 82 substantially equal to the tangential velocity of the surface of the image bearing member 60. The period of time which the gear 68 is locked against rotation establishes the alignment and synchronization period for the registration mechanism 62 by causing the rollers 80, 82 to dwell for a selected period of time. That is to say, a sheet fed to the nip between rollers 80 and 82 during the dwell period will be aligned with the image bearing surface 60, and at the end of the dwell period will be transported toward the surface in synchronized registration to the arrival of a developed image on the surface. The length of the segment 66 is selected such that the length of time of the dwell period is of a duration, dependent upon the angular speed of rotation of the gear 64 (as related to the operative cycle of the image bearing member 60), to receive during the dwell period any sheet fed from the stack.

Figure 7:
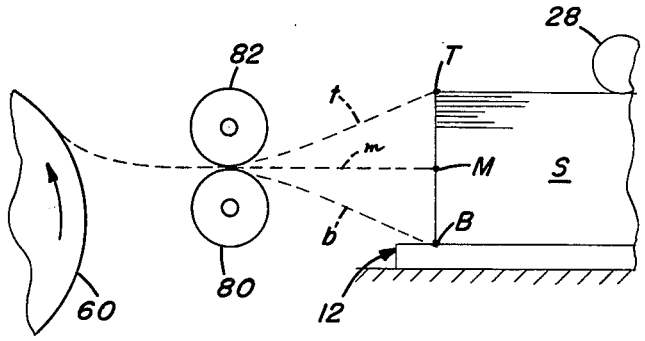
FIG. 7 is a generally schematic illustration of the sheet feed path from the sheet stack in the sheet supply cassette to the registration mechanism, showing the variations in path length for different levels of the sheet stack.

To assure proper alignment and synchronization of the feeding of a sheet with the arrival of the developed image, the duration of the dwell period for the registration mechanism 62 must be such that each sheet from the stack reaches the registration mechanism during the dwell period irrespective of the height of the supply stack S from which the sheet is fed. As illustrated by the curve A in FIG. 8, the elapsed time between when a sheet is fed by the scuff feeder 10 from the stack until it reaches the rollers 80, 82 of the registration mechanism 62 varies as a function of the height of the stack. This is due to the change in feed path length as the stack height changes. As best seen in FIG. 7 the length of the feed paths for the top sheet T or the bottom sheet B of the stack S (designated *t* and *b* respectively) are substantially longer than the length of the feed path m from the mid-point sheet M. Thus the minimum duration of the dwell period, without any correction in time of feeding of the sheets, must be such that a sheet moving along both the shortest length feed path (*m*) and the longest length feed path (*t* or *b*) will reach the registration mechanism 62 during the dwell period $D_1$. The length of the dwell period $D_1$ (in terms of time $\tau$) limits the speed with which reproduction copies can be made. In order to decrease the required duration of the dwell period of the registration mechanism (and thus increase rate at which copies can be made), this invention provides a timing mechanism 86 which regulates the actuation of the sheet feed apparatus 10 dependent upon the instantaneous height of the stack S to compensate for changes in the length of the sheet feed path.

The timing mechanism 86 comprises a pantograph 88 having a first arm 90 supported at one end by the shaft 40 and at its opposite end by the shaft 46. Since the shaft 46 is always located a given distance above the topmost sheet in the stack S, the angular position of the arm 90 (about the axis of the shaft 40) has a direct relationship to the height of the stack. That is to say, as the sheet feed apparatus 10 follows the height of the stack S, the arm 90 changes its angular orientation about the axis of the shaft 40 in correlation to the change in stack height. A second arm 92 of the pantograph is maintained parallel to the arm 90 by equal length arms 94, 96, and thus its angular position is directly related to the height of the sheet stack. The arm 92 is operatively connected (see FIGS. 1 and 5) to a voltage source 98 which includes a variable resistance device such as a potentiometer in its output circuit. The angular position of the arm 92 changes the resistance of the potentiometer to in turn control the level of a voltage signal from the voltage source. The voltage signal is fed as a correcting input to a logic and control unit 100. The logic and control unit 100 is preferably a mini-computer, such as fully described in U.S. Pat. No. 3,914,047 issued in the name of Hunt et al Oct. 21, 1975 and controls the timing of each process step of the operative cycle of the electrophotographic copier. As part of the control of the operative cycle, the logic and control unit 100 sends a signal to the clutch 32 to actuate the clutch to feed a sheet from the stack S to the registration mechanism 62 to be aligned and synchronized with the arrival of an image on the member 60 at the transfer station. By utilizing the correcting input voltage signal from the voltage source 98 to regulate the timing of the signal from the logic and control unit 100 to the clutch 32, the timing of the feeding of a sheet from the supply stack S is adjusted so that the sheet arrives at the registration mechanism 62 during the dwell of rollers 80 and 82.

Figure 8:
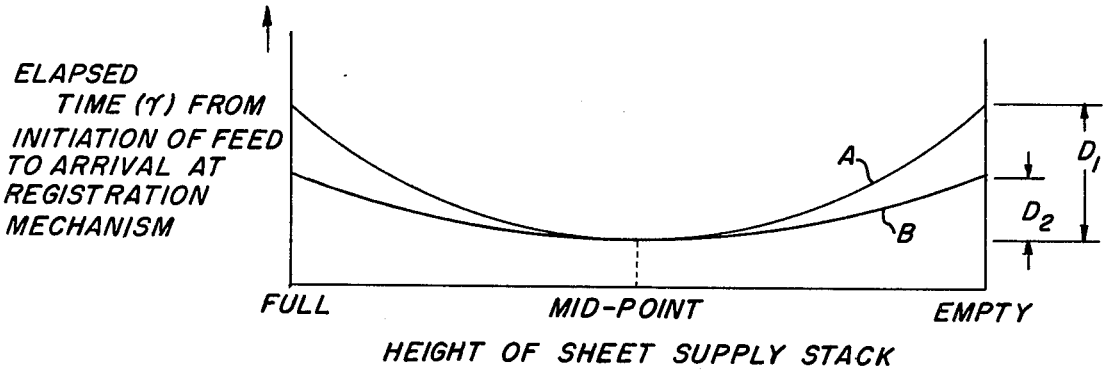
FIG. 8 is a graphical representation plotting the time of arrival of a sheet at the registration mechanism versus the height of the sheet supply stack from which the sheet is fed for a sheet feed apparatus without feed timing correction, and for the sheet feed apparatus with feed timing correction according to this invention.

The effect of the correcting input voltage signal to the logic and control unit 100 can best be seen in curve B of FIG. 8. The mid-point M of the full height of the sheet stack S in the cassette 12 is established as defining the feed path (*m*) of least length between the stack and the registration mechanism 62 (see FIG. 7). When the stack is at its full height, the actuation signal to the clutch 32 must be advanced, with respect to the mid-point clutch actuation signal, to insure that the top sheet T is fed by the sheet feeding apparatus 10 to reach the registration mechanism 62 during the shorter duration dwell period $D_2$. The magnitude of the correcting input voltage signal to the logic and control unit 100, as determined by the angular position of the arm 92 at the full stack height position (setting the resistance of the potentiometer of the voltage source 98) is sufficient to advance the clutch actuation signal by an amount which enables the sheet to reach the registration mechanism during the dwell period $D_2$ (as seen in curve B of FIG. 8). That is to say, if the clutch actuation signal from the logic and control unit 100 were not advanced relative to the mid-point actuation signal, the top sheet T would not be received at the registration mechanism 62 during the dwell period $D_2$ but rather would be received at a time as indicated by the curve A of FIG. 8.

As the stack is depleted, the length of the feed path changes (as shown in FIG. 7) and the actuation of the clutch 32 is changed to keep the feeding of the top sheet in the stack within the time frame where it will reach the registration mechanism within the dwell period $D_2$. This is accomplished by the changing angular position of the arm 92 of the pantograph 88 which correspondingly changes the level of the voltage signal from the voltage source 98 to the logic and control unit 100. Above the mid-point of the full stack height the longer length feed path is decreasing to approach the mid-point path length. Thus the level of the signal from the voltage source is decreased in magnitude to retard the clutch actuation signal with respect to the full height actuation signal (but still advanced with respect to the mid-point actuation signal).

Below the mid-point, the length of the feed path is again increasing (relative to the full stack height mid-point path length) and the actuation signal to the clutch 32 must again be advanced with respect to the timing of the mid-point actuation signal to assure timely actuation of the clutch. When the angular position of the arm 92 drops below its position corresponding to the full stack height mid-point, the magnitude of the correcting input voltage signal from the voltage source 98 to the logic and control unit 100 is increased to advance the clutch actuation signal with respect to the mid-point actuation signal. Accordingly, all sheets in the stack S are fed to the registration mechanism 62 to be received thereat during the dwell period $D_2$, irrespective of the instantaneous height of the stack.

It is therefore apparent that this invention provides a sheet feed apparatus which enables reproduction equipment to operate at a higher speed than heretofore with similar apparatus by adjusting the timing of sheet feeding in accordance with the height of a supply stack of sheets upon which copies are produced, and without the need to incorporate a sheet stack elevator. A scuff roller mechanism of the feed apparatus feeds sheets seriatim from the top of the stack to a registration mechanism. The roller mechanism which follows the top of the stack is mounted on a pivotable arm. The arm is supported to change its angular position in direct relation to the height of the sheet stack. A timing mechanism senses the angular position of the arm and accordingly regulates the time of initiation of the scuff roller feed to accommodate the changes in the length of the feed path to the registration mechanism due to the change in height of the sheet stack.

The invention has been described in detail with particular reference to a preferred embodiment thereof, but it will be understood that variations and modifications can be effected within the spirit and scope of the invention.

I claim:

1. Apparatus for feeding sheets seriatim from the variable top level of a stack of sheets to arrive at a sheet utilization device during a predetermined portion of the time cycle of the utilization device, said apparatus comprising:

means engageable with the top sheet of the stack for feeding such top sheet from the stack;

control means operatively connected to said feeding means for initiating feeding of the top sheet by said feeding means in response to a feed signal;

means for sensing the level of the top sheet in the stack prior to feeding such top sheet from the stack, and for producing a position signal corresponding to such level; and means responsive to said position signal for producing a feed signal, the timing of which varies in accordance with said position signal, and for applying such feed signal to said control means so that the top sheet arrives at the sheet utilization device during said predetermined portion of said time cycle regardless of the level of the stack from which the sheet is fed.

2. The invention of claim 1 wherein said control means comprises a drive motor, and drive means for operatively interconnecting said drive motor and said feeding means, said drive means including clutch means activated by said feed signal for coupling the output of said drive motor to said feeding means to feed the top sheet from said stack.

3. The invention of claim 2 wherein said feeding means comprises a rotatable shaft mounted for free vertical movement above said stack, and a scuff roller fixed on said rotatable shaft in feeding engagement with the top sheet of said stack, and wherein said drive means further includes means for rotating said rotatable shaft in all positions of said shaft.

4. The invention of claim 3 wherein said rotating means of said drive means comprises a first shaft mounted for vertical movement with said rotatable shaft and operatively coupled to said rotatable shaft for imparting rotation thereto, a second shaft coupled to and rotatably driven by said clutch means, and means for drivingly coupling said second shaft to said first shaft whereby upon actuation of said clutch means said drive motor imparts rotation to said scuff roller to feed the top sheet from said stack.

5. The ivention of claim 4 wherein said level sensing means comprises an arm connected at one end to said first shaft and at its opposite end to said second shaft whereby the angular position of said arm about the longitudinal axis of said second shaft changes in direct relation to the vertical movement of said first shaft as the height of the sheet stack changes with the feeding of the top sheet therefrom, and means for determining the angular position of said arm.

6. The invention of claim 5 wherein said means for determining the angular position of said arm comprises a variable voltage output device, a second arm connected to said first arm so as to have a direct positional relationship to said first arm, said second arm coupled to said variable voltage output device to control the voltage output of the device in relation to the position of said second arm.

7. The invention of claim 6 wherein said variable voltage output device includes a voltage source and a variable resistance device, said second arm being connected to said variable resistance device for changing the resistance and thus the voltage output of said voltage source in response to the change in angular position of said second arm.

8. The invention of claim 6 wherein said output of said variable voltage output device is fed as a correcting input to said feed signal producing means to regulate the production of the feed signal.

9. In a sheet feeding apparatus having feed means engageably in with the variable level top sheet of a stack of discrete sheets for feeding the sheets seriatim from the top of the stack to arrive at a sheet utilization device during a predetemined portion of the time cycle of the utilization device, said apparatus including a drive motor, and clutch means for operatively interconnecting said drive motor to said feed means upon actuation of said clutch means, the improvement comprising:

means for sensing the level of the top sheet in the sheet stack prior to the feeding of such top sheet from the stack and for producing a position signal corresponding to such level; and means responsive to said position signal for producing a feed signal, the timing of which varies in accordance with said position signal, and for applying such feed signal to said clutch means to actuate said clutch means whereby said feed means is driven by said drive motor to feed the top sheet from the stack to arrive at the sheet utilization device during said predetermined portion of said time cycle regardless of the level of the stack from which the sheet is fed.

* * * * *